US008086445B2

(12) United States Patent
Wold et al.

(10) Patent No.: US 8,086,445 B2
(45) **Date of Patent: *Dec. 27, 2011**

(54) METHOD AND APPARATUS FOR CREATING A UNIQUE AUDIO SIGNATURE

(75) Inventors: Erling H. Wold, El Cerrito, CA (US); Thomas L. Blum, San Francisco, CA (US); Douglas F. Keislar, Berkeley, CA (US); James A. Wheaton, Fairfax, CA (US)

(73) Assignee: Audible Magic Corporation, Los Gatos, CA (US)

( * ) Notice: Subject to any disclaimer, the term of this patent is extended or adjusted under 35 U.S.C. 154(b) by 116 days.

This patent is subject to a terminal disclaimer.

(21) Appl. No.: 12/482,313

(22) Filed: Jun. 10, 2009

(65) Prior Publication Data

US 2009/0240361 A1 Sep. 24, 2009

Related U.S. Application Data

(63) Continuation of application No. 09/706,227, filed on Nov. 3, 2000, now Pat. No. 7,562,012.

(51) Int. Cl.
*G10L 19/00* (2006.01)

(52) U.S. Cl. ..... 704/200; 704/200.1

(58) Field of Classification Search ..... 704/200, 704/200.1, 500–504

See application file for complete search history.

(56) References Cited

U.S. PATENT DOCUMENTS 3,919,479 A 11/1975 Moon et al.
4,230,990 A 10/1980 Lert, Jr. et al.
4,449,249 A 5/1984 Price
4,450,531 A * 5/1984 Kenyon et al. ..... 708/5
4,454,594 A 6/1984 Heffron et al.
4,677,455 A * 6/1987 Okajima ..... 257/146
4,677,466 A 6/1987 Lert, Jr. et al.
4,739,398 A 4/1988 Thomas et al.
4,843,562 A 6/1989 Kenyon et al.
4,918,730 A * 4/1990 Schulze ..... 704/236
5,210,820 A 5/1993 Kenyon
5,247,688 A 9/1993 Ishigami
5,283,819 A 2/1994 Glick
5,327,521 A 7/1994 Savic et al.

(Continued)

FOREIGN PATENT DOCUMENTS

EP 0349106 A1 1/1990

(Continued)

OTHER PUBLICATIONS

Audible Magic Corporation, "Audio Identification Technology Provides the Cornerstone for Online Distribution," 2000, http://www.audiblemagic.com/documents/Technology_Summary.pdf.

(Continued)

*Primary Examiner* — Michael N Opsasnick
(74) *Attorney, Agent, or Firm* — Lowenstein Sandler PC

(57) ABSTRACT

A method and apparatus for creating a signature of a sampled work in real-time is disclosed herein. Unique signatures of an unknown audio work are created by segmenting a file into segments having predetermined segment and hop sizes. The signature then may be compared against reference signatures. One aspect may be characterized in that the hop size of the sampled work signature is less than the hop size of reference signatures. A method for identifying an unknown audio work is also disclosed.

16 Claims, 7 Drawing Sheets

Present Invention

U.S. PATENT DOCUMENTS

| | | | | |
|---|---|---|---|---|
| 5,437,050 | A | 7/1995 | Lamb et al. | |
| 5,442,645 | A | 8/1995 | Ugon | |
| 5,504,518 | A | 4/1996 | Ellis | |
| 5,581,658 | A | 12/1996 | O'Hagan et al. | |
| 5,588,119 | A | 12/1996 | Vincent | |
| 5,612,729 | A | 3/1997 | Ellis et al. | |
| 5,612,974 | A | 3/1997 | Astrachan | |
| 5,613,004 | A | 3/1997 | Cooperman et al. | |
| 5,638,443 | A | 6/1997 | Stefik | |
| 5,692,213 | A | 11/1997 | Goldberg et al. | |
| 5,701,452 | A | 12/1997 | Siefert | |
| 5,710,916 | A | 1/1998 | Barbara et al. | |
| 5,724,605 | A | 3/1998 | Wissner | |
| 5,732,193 | A | 3/1998 | Aberson | |
| 5,850,388 | A * | 12/1998 | Anderson et al. | 370/252 |
| 5,881,182 | A | 3/1999 | Fiete et al. | |
| 5,918,223 | A * | 6/1999 | Blum et al. | 1/1 |
| 5,924,071 | A | 7/1999 | Morgan et al. | |
| 5,930,369 | A | 7/1999 | Cox et al. | |
| 5,943,422 | A | 8/1999 | Van Wie et al. | |
| 5,949,885 | A | 9/1999 | Leighton | |
| 5,959,659 | A | 9/1999 | Dokic | |
| 5,983,176 | A | 11/1999 | Hoffert et al. | |
| 6,006,183 | A | 12/1999 | Lai et al. | |
| 6,006,256 | A | 12/1999 | Zdepski et al. | |
| 6,011,758 | A | 1/2000 | Dockes | |
| 6,026,439 | A | 2/2000 | Chowdhury | |
| 6,044,402 | A | 3/2000 | Jacobson | |
| 6,067,369 | A | 5/2000 | Kamei | |
| 6,088,455 | A | 7/2000 | Logan et al. | |
| 6,092,040 | A | 7/2000 | Voran | |
| 6,096,961 | A | 8/2000 | Bruti | |
| 6,118,450 | A | 9/2000 | Proehl et al. | |
| 6,192,340 | B1 | 2/2001 | Abecassis | |
| 6,195,693 | B1 | 2/2001 | Berry | |
| 6,229,922 | B1 | 5/2001 | Sasakawa et al. | |
| 6,243,615 | B1 | 6/2001 | Neway | |
| 6,243,725 | B1 | 6/2001 | Hempleman et al. | |
| 6,253,193 | B1 | 6/2001 | Ginter | |
| 6,253,337 | B1 | 6/2001 | Maloney et al. | |
| 6,279,010 | B1 | 8/2001 | Anderson | |
| 6,279,124 | B1 | 8/2001 | Brouwer et al. | |
| 6,285,596 | B1 | 9/2001 | Miura et al. | |
| 6,330,593 | B1 | 12/2001 | Roberts et al. | |
| 6,345,256 | B1 | 2/2002 | Milsted et al. | |
| 6,374,260 | B1 | 4/2002 | Hoffert et al. | |
| 6,385,596 | B1 | 5/2002 | Wiser | |
| 6,418,421 | B1 | 7/2002 | Hurtado et al. | |
| 6,422,061 | B1 | 7/2002 | Sunshine | |
| 6,438,556 | B1 | 8/2002 | Malik et al. | |
| 6,449,226 | B1 | 9/2002 | Kumagai | |
| 6,452,874 | B1 | 9/2002 | Otsuka et al. | |
| 6,453,252 | B1 | 9/2002 | Laroche | |
| 6,460,050 | B1 | 10/2002 | Pace et al. | |
| 6,463,508 | B1 | 10/2002 | Wolf et al. | |
| 6,477,704 | B1 | 11/2002 | Cremia | |
| 6,487,641 | B1 | 11/2002 | Cusson et al. | |
| 6,490,279 | B1 | 12/2002 | Chen et al. | |
| 6,496,802 | B1 | 12/2002 | van Zoest et al. | |
| 6,526,411 | B1 | 2/2003 | Ward | |
| 6,542,869 | B1 | 4/2003 | Foote | |
| 6,550,001 | B1 | 4/2003 | Corwin et al. | |
| 6,550,011 | B1 | 4/2003 | Sims, III | |
| 6,552,254 | B2 | 4/2003 | Hasegawa et al. | |
| 6,591,245 | B1 | 7/2003 | Klug | |
| 6,609,093 | B1 | 8/2003 | Gopinath et al. | |
| 6,609,105 | B2 | 8/2003 | van Zoest et al. | |
| 6,628,737 | B1 | 9/2003 | Timus | |
| 6,636,965 | B1 | 10/2003 | Beyda | |
| 6,654,757 | B1 | 11/2003 | Stern | |
| 6,732,180 | B1 | 5/2004 | Hale | |
| 6,771,316 | B1 | 8/2004 | Iggulden | |
| 6,771,885 | B1 | 8/2004 | Agnihotri et al. | |
| 6,834,308 | B1 | 12/2004 | Ikezoye | |
| 6,947,909 | B1 | 9/2005 | Hoke, Jr. | |
| 6,968,337 | B2 * | 11/2005 | Wold | 1/1 |
| 7,043,536 | B1 | 5/2006 | Philyaw | |
| 7,047,241 | B1 | 5/2006 | Erickson et al. | |
| 7,058,223 | B2 | 6/2006 | Cox et al. | |
| 7,181,398 | B2 | 2/2007 | Thong et al. | |
| 7,266,645 | B2 | 9/2007 | Garg et al. | |
| 7,269,556 | B2 | 9/2007 | Kiss et al. | |
| 7,281,272 | B1 * | 10/2007 | Rubin et al. | 726/26 |
| 7,289,643 | B2 | 10/2007 | Brunk et al. | |
| 7,349,552 | B2 | 3/2008 | Levy et al. | |
| 7,363,278 | B2 | 4/2008 | Schmelzer et al. | |
| 7,426,750 | B2 | 9/2008 | Cooper et al. | |
| 7,443,797 | B2 | 10/2008 | Cheung et al. | |
| 7,500,007 | B2 | 3/2009 | Ikezoye et al. | |
| 7,529,659 | B2 | 5/2009 | Wold | |
| 7,546,120 | B1 | 6/2009 | Ulvenes et al. | |
| 7,562,012 | B1 | 7/2009 | Wold | |
| 7,565,327 | B2 | 7/2009 | Schmelzer | |
| 7,593,576 | B2 | 9/2009 | Meyer et al. | |
| 2001/0013061 | A1 | 8/2001 | DeMartin | |
| 2001/0027493 | A1 | 10/2001 | Wallace | |
| 2001/0027522 | A1 | 10/2001 | Saito | |
| 2001/0034219 | A1 | 10/2001 | Hewitt et al. | |
| 2001/0037304 | A1 | 11/2001 | Paiz | |
| 2001/0041989 | A1 | 11/2001 | Vilcauskas et al. | |
| 2001/0051996 | A1 | 12/2001 | Cooper et al. | |
| 2001/0056430 | A1 | 12/2001 | Yankowski | |
| 2002/0049760 | A1 | 4/2002 | Scott | |
| 2002/0064149 | A1 | 5/2002 | Elliott et al. | |
| 2002/0069098 | A1 | 6/2002 | Schmidt | |
| 2002/0082999 | A1 | 6/2002 | Lee | |
| 2002/0087885 | A1 | 7/2002 | Peled et al. | |
| 2002/0120577 | A1 | 8/2002 | Hans et al. | |
| 2002/0123990 | A1 | 9/2002 | Abe et al. | |
| 2002/0129140 | A1 | 9/2002 | Peled et al. | |
| 2002/0133494 | A1 | 9/2002 | Goedken | |
| 2002/0141384 | A1 | 10/2002 | Liu et al. | |
| 2002/0152261 | A1 | 10/2002 | Arkin et al. | |
| 2002/0152262 | A1 | 10/2002 | Arkin et al. | |
| 2002/0156737 | A1 | 10/2002 | Kahn | |
| 2002/0158737 | A1 | 10/2002 | Yokoyama | |
| 2002/0186887 | A1 | 12/2002 | Rhoads | |
| 2002/0198789 | A1 | 12/2002 | Waldman | |
| 2003/0014530 | A1 | 1/2003 | Bodin | |
| 2003/0018709 | A1 | 1/2003 | Schrempp et al. | |
| 2003/0023852 | A1 | 1/2003 | Wold | |
| 2003/0033321 | A1 | 2/2003 | Schrempp et al. | |
| 2003/0037010 | A1 | 2/2003 | Schmelzer et al. | |
| 2003/0051100 | A1 | 3/2003 | Patel | |
| 2003/0061352 | A1 | 3/2003 | Bohrer | |
| 2003/0061490 | A1 | 3/2003 | Abajian | |
| 2003/0095660 | A1 | 5/2003 | Lee et al. | |
| 2003/0135623 | A1 | 7/2003 | Schrempp et al. | |
| 2003/0191719 | A1 | 10/2003 | Ginter et al. | |
| 2003/0195852 | A1 | 10/2003 | Campbell et al. | |
| 2004/0008864 | A1 | 1/2004 | Watson et al. | |
| 2004/0010495 | A1 | 1/2004 | Kramer et al. | |
| 2004/0053654 | A1 | 3/2004 | Kokumai et al. | |
| 2004/0073513 | A1 | 4/2004 | Stefik et al. | |
| 2004/0089142 | A1 | 5/2004 | Georges et al. | |
| 2004/0133797 | A1 | 7/2004 | Arnold | |
| 2004/0148191 | A1 | 7/2004 | Hoke, Jr. | |
| 2004/0163106 | A1 | 8/2004 | Schrempp et al. | |
| 2004/0167858 | A1 | 8/2004 | Erickson | |
| 2004/0201784 | A9 | 10/2004 | Dagtas et al. | |
| 2005/0021783 | A1 | 1/2005 | Ishii | |
| 2005/0039000 | A1 | 2/2005 | Erickson | |
| 2005/0044189 | A1 | 2/2005 | Ikezoye et al. | |
| 2005/0097059 | A1 | 5/2005 | Shuster | |
| 2005/0154678 | A1 | 7/2005 | Schmelzer | |
| 2005/0154680 | A1 | 7/2005 | Schmelzer | |
| 2005/0154681 | A1 | 7/2005 | Schmelzer | |
| 2005/0216433 | A1 | 9/2005 | Bland et al. | |
| 2005/0267945 | A1 | 12/2005 | Cohen et al. | |
| 2005/0289065 | A1 | 12/2005 | Weare | |
| 2006/0034177 | A1 | 2/2006 | Schrempp | |
| 2006/0062426 | A1 | 3/2006 | Levy et al. | |
| 2007/0074147 | A1 | 3/2007 | Wold | |
| 2007/0078769 | A1 | 4/2007 | Way | |
| 2007/0186229 | A1 | 8/2007 | Conklin et al. | |
| 2007/0226365 | A1 | 9/2007 | Hildreth et al. | |
| 2008/0008173 | A1 | 1/2008 | Kanevsky et al. | |

| | | | |
|---|---|---|---|
| 2008/0019371 | A1 | 1/2008 | Anschutz et al. |
| 2008/0133415 | A1 | 6/2008 | Ginter et al. |
| 2008/0141379 | A1 | 6/2008 | Schmelzer |
| 2008/0154730 | A1 | 6/2008 | Schmelzer |
| 2008/0155116 | A1 | 6/2008 | Schmelzer |
| 2009/0030651 | A1 | 1/2009 | Wold |
| 2009/0031326 | A1 | 1/2009 | Wold |
| 2009/0043870 | A1 | 2/2009 | Ikezoye et al. |
| 2009/0077673 | A1 | 3/2009 | Schmelzer |
| 2009/0089586 | A1 | 4/2009 | Brunk |
| 2009/0192640 | A1 | 7/2009 | Wold |
| 2009/0240361 | A1 | 9/2009 | Wold et al. |
| 2009/0328236 | A1 | 12/2009 | Schmelzer |

FOREIGN PATENT DOCUMENTS

| | | | |
|---|---|---|---|
| EP | 0402210 | A1 | 6/1990 |
| EP | 0517405 | A2 | 5/1992 |
| EP | 0689316 | A2 | 12/1995 |
| EP | 0731446 | | 9/1996 |
| EP | 0859503 | | 8/1998 |
| EP | 0459046 | | 4/1999 |
| EP | 1354276 | B1 | 12/2007 |
| EP | 1485815 | B1 | 10/2009 |
| WO | WO 96/36163 | A3 | 11/1996 |
| WO | WO 98/20672 | A3 | 5/1998 |
| WO | WO 00/05650 | A1 | 2/2000 |
| WO | WO 00/39954 | A1 | 7/2000 |
| WO | WO 00/63800 | A1 | 10/2000 |
| WO | WO 01/23981 | A1 | 4/2001 |
| WO | WO 01/47179 | A1 | 6/2001 |
| WO | WO 01/52540 | A1 | 7/2001 |
| WO | WO 01/62004 | | 8/2001 |
| WO | WO 02/03203 | | 1/2002 |
| WO | WO 02/15035 | | 2/2002 |
| WO | WO 02/37316 | | 5/2002 |
| WO | WO 02/082271 | | 10/2002 |
| WO | WO 03/007235 | A1 | 1/2003 |
| WO | WO 03/009149 | A1 | 1/2003 |
| WO | WO 03/036496 | A1 | 5/2003 |
| WO | WO 03/067459 | A1 | 8/2003 |
| WO | WO 03/091990 | A1 | 11/2003 |
| WO | WO 2004/044820 | A1 | 5/2004 |
| WO | WO 2004/070558 | | 8/2004 |
| WO | WO 2006/015168 | A2 | 2/2006 |
| WO | WO 2009/017710 | | 2/2009 |

OTHER PUBLICATIONS

Baum, L., et al., "A Maximization Technique Occurring in the Statistical Analysis of Probabilistic Functions of Markov Chains," *The Annals of Mathematical Statistics*, vol. 41, No. 1, pp. 164-171, 1970.

Beritelli, F., et al., "Multilayer Chaotic Encryption for Secure Communications in packet switching Networks," IEEE, vol. 2Aug. 2000, pp. 1575-1582.

Blum, T., Keislar, D., Wheaton, J., and Wold, E., "Audio Databases with Content-Based Retrieval," Proceedings of the 1995 International Joint Conference on Artificial Intelligence (IJCAI) Workshop on Intelligent Multimedia Information Retrieval, 1995.

Breslin, Pat, et al., Relatable Website, "Emusic uses Relatable's open source audio recognition solution, TRM, to signature its music catalog for MusicBrainz database," http://www.relatable.com/news/pressrelease/001017.release.html, Oct. 17, 2000.

Business Wire, "Cisco and Fox Host Groundbreaking Screening of Titan A.E.; Animated Epic Will Be First Film Ever to be Digitaly Transmitted Over the Internet Monday," Jun. 5, 2000, 08:14 EDT.

Business Wire, "IBM: IBM Announces New Descrambler Software; First to Offer Software to Work With Digital Video Chips," Jun. 5, 25, 1997, 07:49.

Chen, et al., Yong-Cong, A Secure and Robust Digital Watermaking Technique by the Blcok Cipher RC6 and Secure Hash Algorithm, Deparment of Computer Science, National Tsing Hua University, 2001.

Cosi, P., De Poli, G., Prandoni, P., "Timbre Characterization with Mel-Cepstrum and Neural Nets," Proceedings of the 1994 International Computer Music Conference, pp. 42-45, San Francisco, No date.

Dempster, A.P., et al., "Maximum Likelihood from Incomplete Data via the EM Algorithm" *Journal of the Royal Statistical Society, Series B* (*Methodological*), vol. 39, Issue 1, pp. 31-38, 1977.

Feiten, B. and Gunzel, S., "Automatic Indexing of a Sound Database Using Self-Organizing Neural Nets," Computer Music Journal, 18:3, pp. 53-65, Fall 1994.

Fischer, S., Lienhart, R., and Effelsberg, W., "Automatic Recognition of Film Genres," Reihe Informatik, Jun. 1995, Universitat Mannheim, Praktische Informatik IV, L15, 16, D-68131 Mannheim.

Foote, J., "A Similarity Measure for Automatic Audio Classification," Institute of Systems Science, National University of Singapore, 1977, Singapore.

Gasaway Laura, Close of Century Sees New Copyright Amendments, Mar. 200, Information Outlook, 4, 3, 42.

Gonzalez, R. and Melih, K., "Content Based Retrieval of Audio," The Institute for Telecommunication Research, University of Wollongong, Australia, No date.

Haitsma, J., et al., "Robust Audio Hashing for Content Identification", CBMI 2001, Second International Workshop on Content Based Multimedia and Indexing, Brescia, Italy, Sep. 19-21, 2001.

Harris, Lesley Ellen, "To register or not," Mar. 2006, Information Outlook, 10, 3, 32(s).

Kanth, K.V. et al. "Dimensionality Reduction or Similarity Searching in Databases," Computer Vision and Image understanding, vol. 75, Nos. 1/2 Jul./Aug. 1999, pp. 59-72, Academic Press. Santa Barbara, CA, USA.

Keislar, D., Blum, T., Wheaton, J., and Wold, E., "Audio Analysis for Content-Based Retrieval" Proceedings of the 1995 International Computer Music Conference.

Ohtsuki, K., et al. , "Topic extraction based on continuous speech recognition in broadcast-news speech," Proceedings IEEE Workshop on Automated Speech Recognition and Understanding, 1997, pp. 527-534, N.Y., N.Y., USA.

Packethound Tech Specs, www.palisdesys.com/products/packethount/tck specs/prodPhtechspecs.shtml, 2002.

"How does PacketHound work?", www.palisdesys.com/products/packethound/how__does__it__work/prod__Pghhow.shtml 2002.

Pankanti, Sharath, "Verification Watermarks on Fingerprint Recognition and Retrieval," Part of IS&T/SPIE Conference on Security and Watermarking of Multimedia Contents, San Jose, CA Jan. 1999, SPIE vol. 3657, pp. 66-78.

Pellom, B. et al., "Fast Likelihood Computation Techniques in Nearest-Neighbor search for Continuous Speech Recognition.", *IEEE Signal Processing Letters*, vol. 8, pp. 221-224 Aug. 2001.

Reynolds, D., et al. , "Robust Text-Independent Speaker Identification Using Gaussian Mixture Speaker Models", *IEEE Transactions on Speech and Audio Processing*, vol. 3, No. 1, pp. 72-83 Jan. 1995.

Scheirer, E., Slaney, M., "Construction and Evaluation of a Robust Multifeature Speech/Music Discriminator," pp. 1-4, Proceedings of ICASSP-97, Apr. 2-24, Munich, Germany.

Scheirer, E.D., "Tempo and Beat Analysis of Acoustic Musical Signals," Machine Listening Group, E15-401D MIT Media Laboratory, pp. 1-21, Aug. 8, 1997, Cambridge, MA.

Schneier, Bruce, Applied Cryptography, Protocols, Algorithms and Source Code in C, Chapter 2 Protocol Building Blocks, 1996, pp. 30-31.

Smith, Alan J., "Cache Memories," Computer Surveys, Sep. 1982, University of California, Berkeley, California, vol. 14, No. 3, pp. 1-61.

Vertegaal, R. and Bonis, E., "ISEE: An Intuitive Sound Editing Environment," Computer Music Journal, 18:2, pp. 21-22, Summer 1994.

Wang, Yao, et al., "Multimedia Content Analysis," IEEE Signal Processing Magazine, pp. 12-36, Nov. 2000, IEEE Service Center, Piscataway, N.J., USA.

Wold, Erling, et al., "Content Based Classification, Search and Retrieval of Audio," IEEE Multimedia, vol. 3, No. 3, pp. 27-36, 1996 IEEE Service Center, Piscataway, N.J., USA.

Zawodny, Jeremy, D., "A C Program to Compute CDDB discids on Linus and FreeBSD," [internet] http://jeremy.zawodny.com/c/discid-linux-1.3tar.gz, 1 page, Apr. 14, 2001, retrieved Jul. 17, 2007.

European Patent Application No. 02752347.1, Supplementary European Search Report Dated May 8, 2006, 4 pages.

European Patent Application No. 02756525.8, Supplementary European Search Report Dated Jun. 28, 2006, 4 pages.
European Patent Application No. 02782170, Supplementary European Search Report Dated Feb. 4, 2007, 4 pages.
European Patent Application No. 02725522.3, Supplementary European Search Report Dated May 12, 2006, 2 Pages.
European Patent Application No. 04706547.9 European Search Report Dated Feb. 25, 2010, 3 Pages.
European Patent Application No. 05778109.8 European Search Report Dated Sep. 10, 2010, 7 Pages.
PCT Search Report PCT/US01/50295, International Search Report dated May 14, 2003, 5 Pages.
PCT Search Report PCT/US02/10615, International Search Report dated Aug. 7, 2002, 5 Pages.
PCT Search Report PCT/US02/33186, International Search Report dated Dec. 16, 2002, 6 Pages.
PCT Search Report PCT/US04/02748, International Search Report and Written Opinion dated Aug. 20, 2007, 8 Pages.
PCT Search Report PCT/US05/26887, International Search Report dated May 3, 2006, 3 Pages.
PCT Search Report PCT/US08/09127, International Search Report dated Oct. 30, 2008, 8 Pages.
Audible Magic Office Action for U.S. Appl. No. 09/511,632 mailed Dec. 4, 2002.
Audible Magic Office Action for U.S. Appl. No. 09/511,632 mailed May 13, 2003.
Audible Magic Office Action for U.S. Appl. No. 09/511,632 mailed Aug. 27, 2003.
Audible Magic Office Action for U.S. Appl. No. 09/511,632 mailed Feb. 5, 2004.
Audible Magic Notice of Allowance for U.S. Appl. No. 09/511,632 mailed Aug. 10, 2004.
Audible Magic Notice of Allowance for U.S. Appl. No. 10/955,841 mailed Sep. 25, 2006.
Audible Magic Notice of Allowance for U.S. Appl. No. 10/955,841 mailed Mar. 23, 2007.
Audible Magic Notice of Allowance for U.S. Appl. No. 10/955,841 mailed Sep. 11, 2007.
Audible Magic Notice of Allowance for U.S. Appl. No. 10/955,841 mailed Feb. 25, 2008.
Audible Magic Notice of Allowance for U.S. Appl. No. 12/251,404 mailed May 14, 2010.
Audible Magic Office Action for U.S. Appl. No. 08/897,662 mailed Aug. 13, 1998.
Audible Magic Notice of Allowance for U.S. Appl. No. 08/897,662 mailed Jan. 29, 1999.
Audible Magic Office Action for U.S. Appl. No. 09/706,227 mailed May 5, 2004.
Audible Magic Office Action for U.S. Appl. No. 09/706,227 mailed Nov. 12, 2004.
Audible Magic Office Action for U.S. Appl. No. 09/706,227 mailed May 9, 2005.
Audible Magic Office Action for U.S. Appl. No. 09/706,227 mailed Nov. 1, 2005.
Audible Magic Office Action for U.S. Appl. No. 09/706,227 mailed Jun. 23, 2006.
Audible Magic Office Action for U.S. Appl. No. 09/706,227 mailed Nov. 7, 2006.
Audible Magic Office Action for U.S. Appl. No. 09/706,227 mailed Mar. 29, 2007.
Audible Magic Office Action for U.S. Appl. No. 09/706,227 mailed Sep. 17, 2007.
Audible Magic Office Action for U.S. Appl. No. 09/706,227 mailed May 29, 2008.
Audible Magic Office Action for U.S. Appl. No. 09/706,227 mailed Jan. 9, 2009.
Audible Magic Office Action for U.S. Appl. No. 10/192,783 mailed Dec. 13, 2004.
Audible Magic Notice of Allowance for U.S. Appl. No. 10/192,783 mailed Jun. 7, 2005.
Audible Magic Office Action for U.S. Appl. No. 11/239,543 mailed Apr. 23, 2008.
Audible Magic Notice of Allowance for U.S. Appl. No. 11/239,543 mailed Nov. 6, 2008.
Audible Magic Notice of Allowance for U.S. Appl. No. 11/239,543 mailed Feb. 25, 2009.
Audible Magic Office Action for U.S. Appl. No. 12/410,445 mailed Aug. 10, 2010.
Audible Magic Notice of Allowance for U.S. Appl. No. 12/410,445 mailed Oct. 20, 2010.
Audible Magic Office Action for U.S. Appl. No. 09/910,680 mailed Nov. 17, 2004.
Audible Magic Office Action for U.S. Appl. No. 09/910,680 mailed May 16, 2005.
Audible Magic Office Action for U.S. Appl. No. 09/910,680 mailed Sep. 29, 2005.
Audible Magic Office Action for U.S. Appl. No. 09/910,680 mailed Jun. 23, 2006.
Audible Magic Office Action for U.S. Appl. No. 09/910,680 mailed Aug. 8, 2006.
Audible Magic Office Action for U.S. Appl. No. 09/910,680 mailed Jan. 25, 2007.
Audible Magic Office Action for U.S. Appl. No. 09/910,680 mailed Dec. 5, 2007.
Audible Magic Office Action for U.S. Appl. No. 09/999,763 mailed Apr. 6, 2005.
Audible Magic Office Action for U.S. Appl. No. 09/999,763 mailed Oct. 6, 2005.
Audible Magic Office Action for U.S. Appl. No. 09/999,763 mailed Apr. 7, 2006.
Audible Magic Office Action for U.S. Appl. No. 09/999,763 mailed Oct. 6, 2006.
Audible Magic Office Action for U.S. Appl. No. 09/999,763 mailed Mar. 7, 2007.
Audible Magic Office Action for U.S. Appl. No. 09/999,763 mailed Aug. 20, 2007.
Audible Magic Office Action for U.S. Appl. No. 09/999,763 mailed Jan. 7, 2008.
Audible Magic Office Action for U.S. Appl. No. 09/999,763 mailed Jun. 27, 2008.
Audible Magic Office Action for U.S. Appl. No. 09/999,763 mailed Dec. 22, 2008.
Audible Magic Office Action for U.S. Appl. No. 09/999,763 mailed Jul. 20, 2009.
Audible Magic Office Action for U.S. Appl. No. 09/999,763 mailed Dec. 21, 2009.
Audible Magic Office Action for U.S. Appl. No. 09/999,763 mailed Jun. 23, 2010.
Audible Magic Notice of Allowance for U.S. Appl. No. 09/999,763 mailed Sep. 16, 2010.
Audible Magic Office Action for U.S. Appl. No. 10/072,238 mailed May 3, 2005.
Audible Magic Office Action for U.S. Appl. No. 10/072,238 mailed Oct. 25, 2005.
Audible Magic Office Action for U.S. Appl. No. 10/072,238 mailed Apr. 26, 2006.
Audible Magic Office Action for U.S. Appl. No. 10/072,238 mailed Sep. 19, 2007.
Audible Magic Office Action for U.S. Appl. No. 10/072,238 mailed Apr. 7, 2008.
Audible Magic Office Action for U.S. Appl. No. 10/072,238 mailed Oct. 1, 2008.
Audible Magic Office Action for U.S. Appl. No. 10/072,238 mailed Jan. 9, 2009.
Audible Magic Office Action for U.S. Appl. No. 10/072,238 mailed Mar. 31, 2009.
Audible Magic Office Action for U.S. Appl. No. 10/072,238 mailed Aug. 6, 2010.
Audible Magic Office Action for U.S. Appl. No. 11/116,710 mailed Dec. 13, 2004.
Audible Magic Office Action for U.S. Appl. No. 11/116,710 mailed Apr. 8, 2005.
Audible Magic Office Action for U.S. Appl. No. 11/116,710 mailed Oct. 7, 2005.

Audible Magic Office Action for U.S. Appl. No. 11/116,710 mailed Apr. 20, 2006.
Audible Magic Office Action for U.S. Appl. No. 11/116,710 mailed Jul. 31, 2006.
Audible Magic Office Action for U.S. Appl. No. 11/116,710 mailed Jan. 16, 2007.
Audible Magic Notice of Allowance for U.S. Appl. No. 11/116,710 mailed Nov. 19, 2007.
Audible Magic Office ACtion for U.S. Appl. No. 12/042,023 mailed Dec. 29, 2008.
Audible Magic Office Action for U.S. Appl. No. 12/042,023 mailed Jun. 25, 2009.
Audible Magic Notice of Allowance for U.S. Appl. No. 12/042,023 mailed Mar. 8, 2010.
Audible Magic Office Action for U.S. Appl. No. 11/048,307 mailed Aug. 22, 2007.
Audible Magic Office Action for U.S. Appl. No. 11/048,307 mailed May 16, 2008.
Audible Magic Notice of Allowance for U.S. Appl. No. 11/048,307 mailed May 29, 2009.
Audible Magic Office Action for U.S. Appl. No. 12/488,504 mailed Nov. 10, 2010.
Audible Magic Office Action for U.S. Appl. No. 11/048,308 mailed Feb. 25, 2008.
Audible Magic Office Action for U.S. Appl. No. 11/048,308 mailed Mar. 5, 2009.
Audible Magic Notice of Allowance for U.S. Appl. No. 11/048,308 mailed Aug. 7, 2009.
Audible Magic Office Action for U.S. Appl. No. 11/048,338 mailed Apr. 18, 2007.
Audible Magic Office Action for U.S. Appl. No. 11/048,338 mailed Oct. 11, 2007.
Audible Magic Office Action for U.S. Appl. No. 11/048,338 mailed Jan. 14, 2008.
Audible Magic Office Action for U.S. Appl. No. 11/048,338 mailed Jul. 9, 2008.
Audible Magic Office Action for U.S. Appl. No. 11/048,338 mailed Jan. 7, 2009.
Audible Magic Office Action for U.S. Appl. No. 11/048,338 mailed Jul. 6, 2009.
Audible Magic Office Action for U.S. Appl. No. 11/048,338 mailed Dec. 28, 2009.
Audible Magic Office Action for U.S. Appl. No. 11/048,338 mailed Jun. 24, 2010.
Audible Magic Office Action for U.S. Appl. No. 12/035,599 mailed Nov. 17, 2008.
Audible Magic Office Action for U.S. Appl. No. 12/035,599 mailed May 29, 2009.
Audible Magic Office Action for U.S. Appl. No. 12/035,599 mailed Nov. 24, 2009.
Audible Magic Office Action for U.S. Appl. No. 12/035,599 mailed Jun. 9, 2010.
Audible Magic Office Action for U.S. Appl. No. 12/035,609 mailed Dec. 29, 2008.
Audible Magic Office Action for U.S. Appl. No. 12/035,609 mailed Jun. 24, 2009.
Audible Magic Notice of Allowance for U.S. Appl. No. 12/035,609 mailed Dec. 11, 2009.
Audible Magic Notice of Allowance for U.S. Appl. No. 12/277,291 mailed May 12, 2010.
Audible Magic Office Action for U.S. Appl. No. 10/356,318 mailed May 24, 2006.
Audible Magic Office Action for U.S. Appl. No. 10/356,318 mailed Nov. 2, 2006.
Audible Magic Office Action for U.S. Appl. No. 10/356,318 mailed Apr. 11, 2007.
Audible Magic Office Action for U.S. Appl. No. 10/356,318 mailed Nov. 1, 2007.
Audible Magic Office Action for U.S. Appl. No. 10/356,318 mailed May 9, 2008.
Audible Magic Office Action for U.S. Appl. No. 10/356,318 mailed Jan. 6, 2009.
Audible Magic Office Action for U.S. Appl. No. 10/356,318 mailed Jun. 15, 2009.
Audible Magic Office Action for U.S. Appl. No. 10/356,318 mailed Jan. 21, 2010.
Audible Magic Office Action for U.S. Appl. No. 10/356,318 mailed Jan. 7, 2011.
Audible Magic Office Action for U.S. Appl. No. 11/191,493 mailed Jul. 17,2008.
Audible Magic Office Action for U.S. Appl. No. 11/191,493 mailed Jan. 9, 2009.
Audible Magic Office Action for U.S. Appl. No. 11/191,493 mailed Apr. 28, 2009.
Audible Magic Office Action for U.S. Appl. No. 11/191,493 mailed Nov. 19, 2009.
Audible Magic Office Action for U.S. Appl. No. 11/191,493 mailed May 25, 2010.
Audible Magic Office Action for U.S. Appl. No. 11/191,493 mailed Oct. 4, 2010.
Audible Magic Office Action for U.S. Appl. No. 11/829,662 mailed Oct. 8, 2010.
Audible Magic Office Action for U.S. Appl. No. 11/923,491 mailed Nov. 12, 2010.
Audible Magic Office Action for U.S. Appl. No. 12/405,174 mailed Mar. 2, 2011.

* cited by examiner

Present Invention

Present Invention

Present Invention

Present Invention

Present Invention

Present Invention

Present Invention

METHOD AND APPARATUS FOR CREATING A UNIQUE AUDIO SIGNATURE

PRIORITY CLAIM

This application is a continuation of U.S. patent application Ser. No. 09/706,227, filed Nov. 3, 2000, now U.S. Pat. No. 7,562,012, which is hereby incorporated by reference.

FIELD OF THE INVENTION

The present invention relates to data communications. In particular, the present invention relates to creating a unique audio signature.

The Prior Art

BACKGROUND

Digital audio technology has greatly changed the landscape of music and entertainment. Rapid increases in computing power coupled with decreases in cost have made it possible individuals to generate finished products having a quality once available only in a major studio. Once consequence of modern technology is that legacy media storage standards, such as reel-to-reel tapes, are being rapidly replaced by digital storage media, such as the Digital Versatile Disk (DVD), and Digital Audio Tape (DAT). Additionally, with higher capacity hard drives standard on most personal computers, home users may now store digital files such as audio or video tracks on their home computers.

Furthermore, the Internet has generated much excitement, particularly among those who see the Internet as an opportunity to develop new avenues for artistic expression and communication. The Internet has become a virtual gallery, where artists may post their works on a Web page. Once posted, the works may be viewed by anyone having access to the Internet.

One application of the Internet that has received considerable attention is the ability to transmit recorded music over the Internet. Once music has been digitally encoded into a file, the file may be both downloaded by users for play, or broadcast ("streamed") over the Internet. When files are streamed, they may be listened to by Internet users in a manner much like traditional radio stations.

Given the widespread use of digital media, digital audio files, or digital video files containing audio information, may need to be identified. The need for identification of digital files may arise in a variety of situations. For example, an artist may wish to verify royalty payments or generate their own Arbitron®-like ratings by identifying how often their works are being streamed or downloaded. Additionally, users may wish to identify a particular work. The prior art has made efforts to create methods for identifying digital audio works.

However, systems of the prior art suffer from certain disadvantages. For example, prior art systems typically create a reference signature by examining the copyrighted work as a whole, and then creating a signature based upon the audio characteristics of the entire work However, examining a work in total can result in a signature may not accurately represent the original work. Often, a work may have distinctive passages which may not be reflected in a signature based upon the total work. Furthermore, often works are electronically processed prior to being streamed or downloaded, in a manner that may affect details of the work's audio characteristics, which may result in prior art systems missing the identification of such works. Examples of such electronic processing include data compression and various sorts of audio signal processing such as equalization.

Hence, there exists a need to provide a system which overcomes the disadvantages of the prior art.

BRIEF DESCRIPTION OF THE INVENTION

The present invention relates to data communications. In particular, the present invention relates to creating a unique audio signature.

A method for creating a signature of a sampled work in real-time is disclosed herein. One aspect of the present invention comprises: receiving a sampled work; segmenting the sampled work into a plurality of segments, the segments having predetermined segment and hop sizes; creating a signature of the sampled work based upon the plurality of segments; and storing the sampled work signature. Additional aspects include providing a plurality of reference signatures having a segment size and a hop size. An additional aspect may be characterized in that the hop size of the sampled work signature is less than the hop size of the reference signatures.

An apparatus for creating a signature of a sampled work in real-time is also disclosed. In a preferred aspect, the apparatus comprises: means for receiving a sampled work; means for segmenting the sampled work into a plurality of segments, the segments having predetermined segment and hop sizes; means for creating a signature of the sampled work based upon the plurality of segments; and storing the sampled work signature. Additional aspects include means for providing a plurality of reference signatures having a segment size and a hop size. An additional aspect may be characterized in that the hop size of the sampled work signature is less than the hop size of the reference signatures.

A method for identifying an unknown audio work is also disclosed. In another aspect of the present invention, the method comprises: providing a plurality of reference signatures each having a segment size and a hop size; receiving a sampled work; creating a signature of the sampled work, the sampled work signature having a segment size and a hop size; storing the sampled work signature; comparing the sampled work signature to the plurality of reference signatures to determine whether there is a match; and wherein the method is characterized in that the hop size of the sampled work signature is less than the hop size of the reference signatures.

Further aspects of the present invention include creating a signature of the sampled work by calculating segment feature vectors for each segment of the sampled work. The segment feature vectors may include MFCCs calculated for each segment.

BRIEF DESCRIPTION OF THE DRAWING FIGURES

DETAILED DESCRIPTION OF PREFERRED EMBODIMENTS

Persons of ordinary skill in the art will realize that the following description of the present invention is illustrative only and not in any way limiting. Other embodiments of the invention will readily suggest themselves to such skilled persons having the benefit of this disclosure.

It is contemplated that the present invention may be embodied in various computer and machine-readable data structures. Furthermore, it is contemplated that data structures embodying the present invention will be transmitted across computer and machine-readable media, and through communications systems by use of standard protocols such as those used to enable the Internet and other computer networking standards.

The invention further relates to machine-readable media on which are stored embodiments of the present invention. It is contemplated that any media suitable for storing instructions related to the present invention is within the scope of the present invention. By way of example, such media may take the form of magnetic, optical, or semiconductor media.

The present invention may be described through the use of flowcharts. Often, a single instance of an embodiment of the present invention will be shown. As is appreciated by those of ordinary skill in the art, however, the protocols, processes, and procedures described herein may be repeated continuously or as often as necessary to satisfy the needs described herein. Accordingly, the representation of the present invention through the use of flowcharts should not be used to limit the scope of the present invention.

The present invention may also be described through the use of web pages in which embodiments of the present invention may be viewed and manipulated. It is contemplated that such web pages may be programmed with web page creation programs using languages standard in the art such as HTML or XML. It is also contemplated that the web pages described herein may be viewed and manipulated with web browsers running on operating systems standard in the art, such as the Microsoft Windows® and Macintosh® versions of Internet Explorer® and Netscape®. Furthermore, it is contemplated that the functions performed by the various web pages described herein may be implemented through the use of standard programming languages such a Java® or similar languages.

The present invention will first be described in general overview. Then, each element will be described in further detail below.

Figure 1:
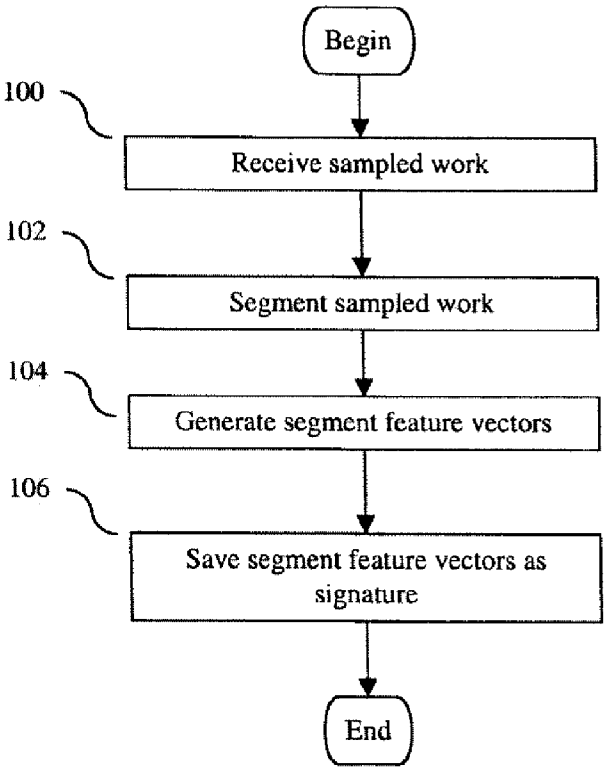
FIG. 1 is a flowchart of a method according to the present invention.

Referring now to FIG. 1, a flowchart is shown which provides a general overview of the present invention. The present invention may be viewed as three steps: 1) receiving a sampled work; 2) segmenting the work; 3) creating signatures of the segments; and 4) storing the signatures of the segments.

Receiving a Sampled Work

Beginning with act 100, a sampled work is provided to the present invention. It is contemplated that the work will be provided to the present invention as a digital audio stream.

It should be understood that if the audio is in analog form, it may be digitized in a manner standard in the art.

Segmenting the Work

After the sampled worked is received, the work is then segmented in act 102. It is contemplated that the sampled work may be segmented into predetermined lengths. Though segments may be of any length, the segments of the present invention are preferably of the same length.

In an exemplary non-limiting embodiment of the present invention, the segment lengths are in the range of 0.5 to 3 seconds. It is contemplated that if one were searching for very short sounds (e.g., sound effects such as gunshots), segments as small as 0.01 seconds may be used in the present invention. Since humans don't resolve audio changes below about 0.018 seconds, segment lengths less than 0.018 seconds may not be useful. On the other hand, segment lengths as high as 30-60 seconds may be used in the present invention. The inventors have found that beyond 30-60 seconds may not be useful, since most details in the signal tend to average out.

Generating Signatures

Next, in act 104, each segment is analyzed to produce a signature, known herein as a segment feature vector. It is contemplated that a wide variety of methods known in the art may be used to analyze the segments and generate segment feature vectors. In an exemplary non-limiting embodiment of the present invention, the segment feature vectors may be created using the method described in U.S. Pat. No. 5,918,223 to Blum, et al, which is incorporated by reference as though set forth fully herein.

Storing the Signatures

In act 106, the segment feature vectors are stored to create a representative signature of the sampled work.

Each above-listed step will now be shown and described in detail.

Figure 2:
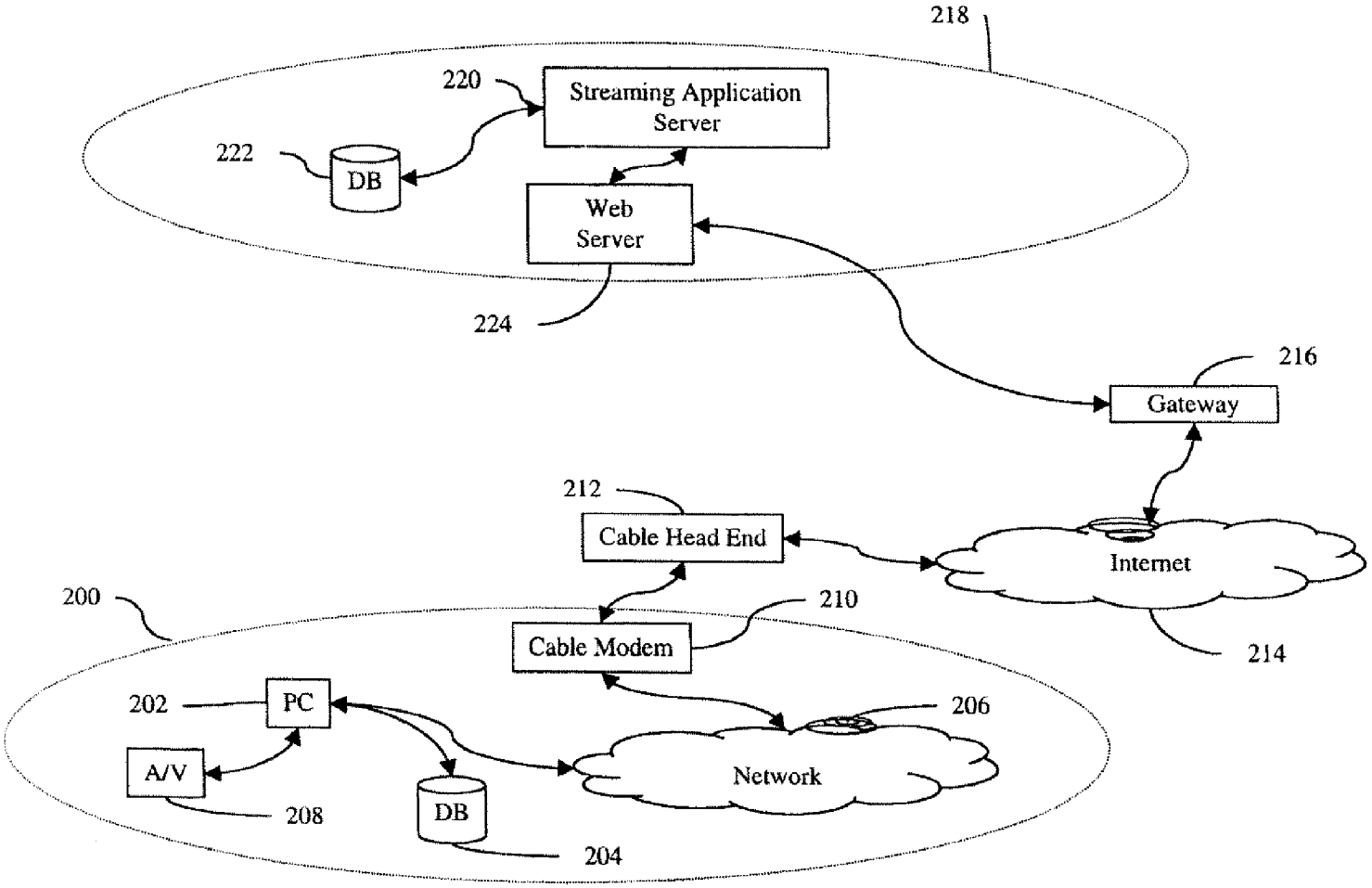
FIG. 2 is a diagram of a system suitable for use with the present invention.

Referring now to FIG. 2, a diagram of a system suitable for use with the present invention is shown. FIG. 2 includes a client system 200. It is contemplated that client system 200 may comprise a personal computer 202 including hardware and software standard in the art to run an operating system such as Microsoft Windows® MAC OS®), or other operating systems standard in the art. Client system 200 may further include a database 204 for storing and retrieving embodiments of the present invention. It is contemplated that database 204 may comprise hardware and software standard in the art and may be operatively coupled to PC 202. Database 204 may also be used to store and retrieve the works and segments utilized by the present invention.

Client system 200 may further include an audio/video (A/V) input device 208. A/V device 208 is operatively coupled to PC 202 and is configured to provide works to the present invention which may be stored in traditional audio or video formats. It is contemplated that A/V device 208 may comprise hardware and software standard in the art configured to receive and sample audio works (including video containing audio information), and provide the sampled works to the present invention as digital audio files. Typically, the A/V input device 208 would supply raw audio samples in a format such as 16-bit stereo PCM format. A/V input device 208 provides an example of means for receiving a sampled work.

It is contemplated that sampled works may be obtained over the Internet, also. Typically, streaming media over the Internet is provided by a provider, such as provider 218 of FIG. 2. Provider 218 includes a streaming application server 220, configured to retrieve works from database 222 and stream the works in a formats standard in the art, such as Real®, Windows Media®, or QuickTime®. The server then provides the streamed works to a web server 224, which then provides the streamed work to the Internet 214 through a gateway 216. Internet 214 may be any packet-based network standard in the art, such as IP, Frame Relay, or ATM.

To reach the provider 218, the present invention may utilize a cable or DSL head end 212 standard in the art operatively, which is coupled to a cable modem or DSL modem 210 which is in turn coupled to the system's network 206. The network 206 may be any network standard in the art, such as a LAN provided by a PC 202 configured to run software standard in the art.

It is contemplated that the sampled work received by system 200 may contain audio information from a variety of sources known in the art, including, without limitation, radio, the audio portion of a television broadcast, Internet radio, the audio portion of an Internet video program or channel, streaming audio from a network audio server, audio delivered to personal digital assistants over cellular or wireless communication systems, or cable and satellite broadcasts.

Additionally, it is contemplated that the present invention may be configured to receive and compare segments coming from a variety of sources either stored or in real-time. For example, it is contemplated that the present invention may compare a real-time streaming work coming from streaming server 218 or A/V device 208 with a reference segment stored in database 204.

Figure 3:
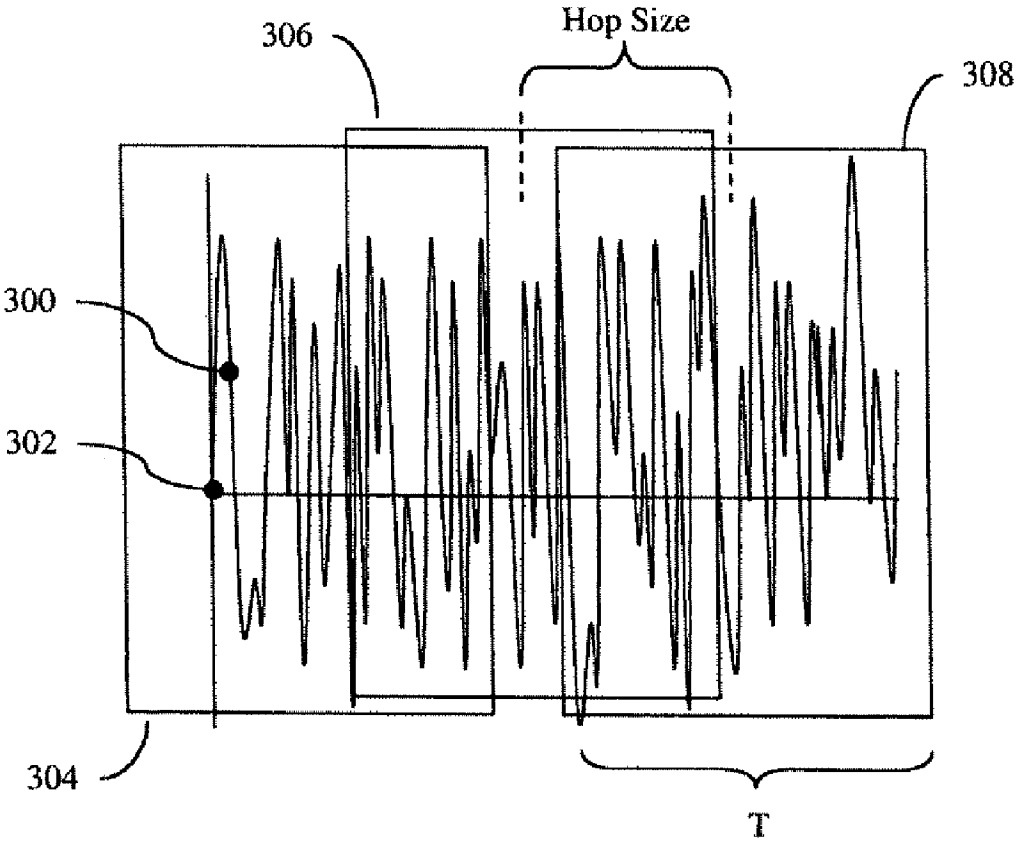
FIG. 3 is a diagram of segmenting according to the present invention.

FIG. 3 shows a diagram showing the segmenting of a work according to the present invention. FIG. 3 includes audio information 300 displayed along a time axis 302. FIG. 3 further includes a plurality of segments 304,306, and 308 taken of audio information 300 over some segment size T.

In an exemplary non-limiting embodiment of the present invention, instantaneous values of a variety of acoustic features are computed at a low level, preferably about 100 times a second. Additionally, 10 MFCCs (cepstral coefficients) are computed for each segment. It is contemplated that any number of MFCCs may be computed. Preferably, 5-20 MFCCs are computed, however, as many as 30 MFCCs may be computed, depending on the need for accuracy versus speed.

In an exemplary non-limiting embodiment of the present invention, the segment-level acoustical features comprise statistical measures as disclosed in the '223 patent of these low-level features calculated over the length of each segment. The data structure may store other bookkeeping information as well (segment size, hop size, item ID, UPC, etc).

As can be seen by inspection of FIG. 3, the segments 304,306, and 308 may overlap in time. This amount of overlap may be represented by measuring the time between the center point of adjacent segments. This amount of time is referred to herein as the hop size of the segments, and is so designated in FIG. 3. By way of example, if the segment length T of a given segment is one second, and adjacent segments overlap by 50%, the hop size would be 0.5 second.

The hop size may be set during the development of the software. Additionally, the hop sizes of the reference database and the real-time segments may be predetermined to facilitate compatibility. For example, the reference signatures in the reference database may be precomputed with a fixed hop and segment size, and thus the client applications should conform to this segment size and have a hop size which integrally divides the reference signature hop size. It is contemplated that one may experiment with a variety of segment sizes in order to balance the tradeoff of accuracy with speed of computation for a given application.

The inventors have found that by carefully choosing the hop size of the segments, the accuracy of the identification process may be significantly increased. Additionally, the inventors have found that the accuracy of the identification process may be increased if the hop size of reference segments and the hop size of segments obtained in real-time are each chosen independently. The importance of the hop size of segments may be illustrated by examining the process for segmenting pre-recorded works and real-time works separately.

Reference Signatures

Prior to attempting to identify a given work, a reference database of signatures must be created. When building a reference database, a segment length having a period of less than three seconds is preferred. In an exemplary non-limiting embodiment of the present invention, the segment lengths have a period ranging from 0.5 seconds to 3 seconds. For a reference database, the inventors have found that a hop size of approximately 50% to 100% of the segment size is preferred.

It is contemplated that the reference signatures may be stored on a database such as database 204 as described above. Database 204 and the discussion herein provide an example of means for providing a plurality of reference signatures each having a segment size and a hop size.

Real-Time Signatures

The choice of the hop size is important for real-time segments.

Figure 4:
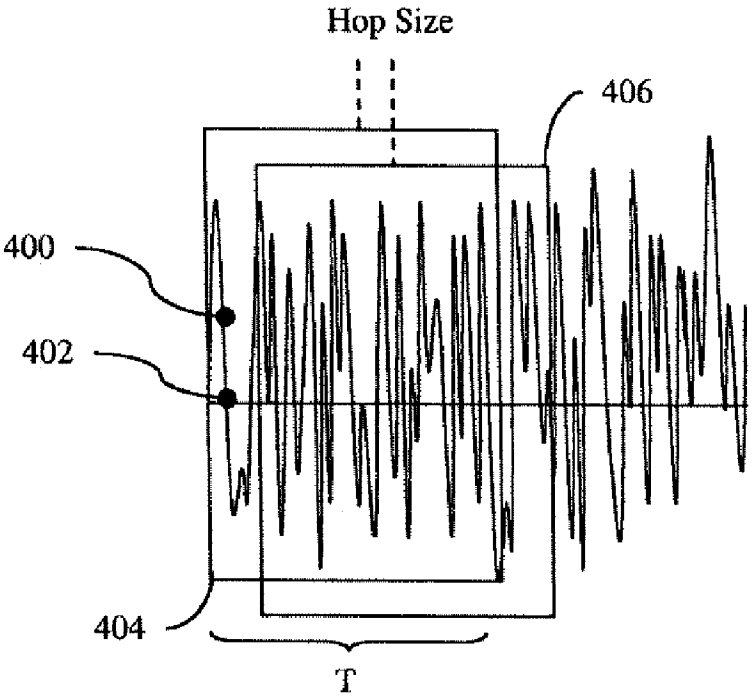
FIG. 4 is a detailed diagram of segmenting according to the present invention showing hop size.

FIG. 4 shows a detailed diagram of a real-time segment according to the present invention. FIG. 4 includes real-time audio information 400 displayed along a time axis 402. FIG. 4 further includes segments 404 and 406 taken of audio information 400 over some segment length T. In an exemplary non-limiting embodiment of the present invention, the segment length of real-time segments is chosen to range from 0.5 to 3 seconds.

As can be seen by inspection of FIG. 4, the hop size of real-time is chosen to be smaller than that of reference segments. In an exemplary non-limiting embodiment of the present invention, the hop size of real-time segments is less than 50% of the segment size. In yet another exemplary non-limiting embodiment of the present invention, the real-time hop size may be 0.1 seconds.

The inventors have found such a small hop size advantageous for the following reasons. The ultimate purpose of generating real-time segments is to analyze and compare them with the reference segments in the database to look for matches. The inventors have found at least two major reasons why a segment of the same audio recording captured real-time would not match its counterpart in the database. One is that the broadcast channel does not produce a perfect copy of the original. For example, the work may be edited or processed or the announcer may talk over part of the work. The other reason is that larger segment boundaries may not line up in time with the original segment boundaries of the target recordings.

The inventors have found that by choosing a smaller hop size, some of the segments will ultimately have time boundaries that line up with the original segments, notwithstanding the problems listed above. The segments that line up with a "clean" segment of the work may then be used to make an accurate comparison while those that do not so line up may be ignored. The inventors have found that a hop size of 0.1 seconds seems to be the maximum that would solve this time shifting problem.

Figure 5:
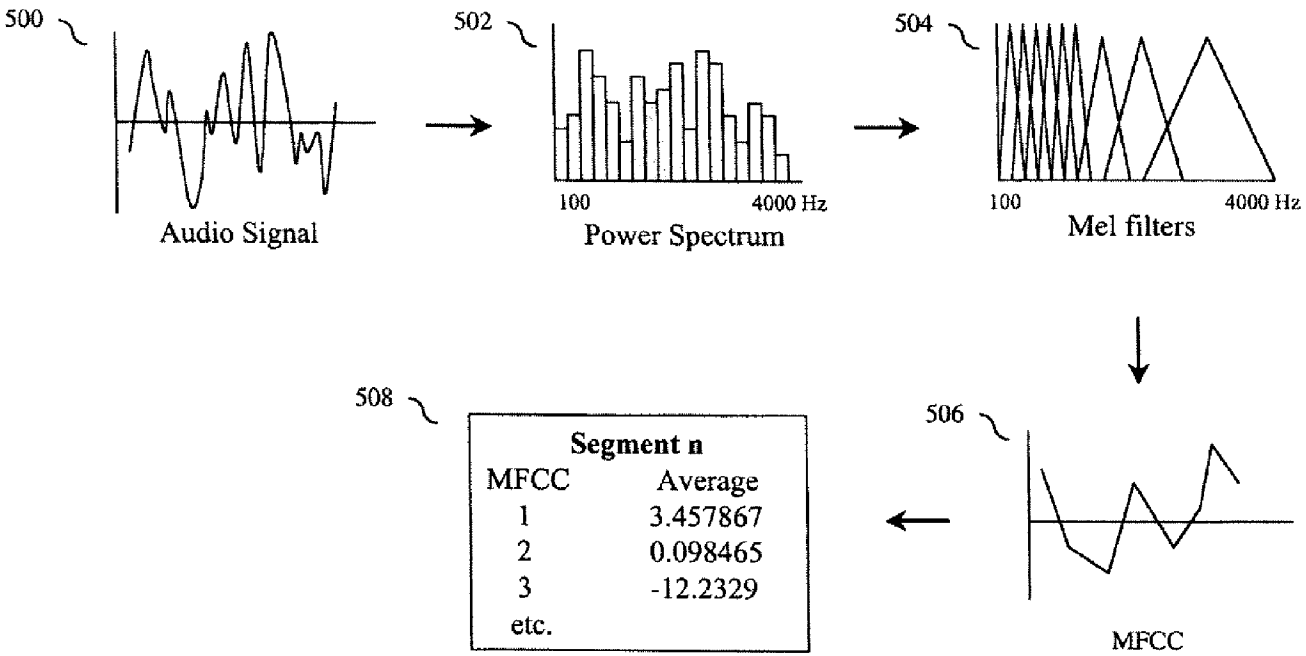
FIG. 5 is a graphical flowchart showing the creating of a segment feature vector according to the present invention.

As mentioned above, once a work has been segmented, the individual segments are then analyzed to produce a segment feature vector. FIG. 5 is a diagram showing an overview of how the segment feature vectors may be created using the methods described in U.S. Pat. No. 5,918,223 to Blum, et al. It is contemplated that a variety of analysis methods may be useful in the present invention, and many different features may be used to make up the feature vector. The inventors have found that the pitch, brightness, bandwidth, and loudness features of the '223 patent to be useful in the present invention. Additionally, spectral features may be used analyzed, such as the energy in various spectral bands. The inventors have found that the cepstral features (MFCCs) are very robust (more invariant) given the distortions typically introduced during broadcast, such as EQ, multi-band compression/limiting, and audio data compression techniques such as MP3 encoding/decoding, etc.

In act 500, the audio segment is sampled to produce a segment. In act 502, the sampled segment is then analyzed using Fourier Transform techniques to transform the signal into the frequency domain. In act 504, mel frequency filters are applied to the transformed signal to extract the significant audible characteristics of the spectrum. In act 506, a Discrete Cosine Transform is applied which converts the signal into mel frequency cepstral coefficients (MFCCs). Finally, in act 508, the MFCCs are then averaged over a predetermined period. In an exemplary non-limiting embodiment of the present invention, this period is approximately one second. Additionally, other characteristics may be computed at this time, such as brightness or loudness. A segment feature vector is then produced which contains a list containing at least the 10 MFCCs corresponding average.

The disclosure of FIGS. 3, 4, and 5 provide examples of means for creating a signature of a sampled work having a segment size and a hop size.

Figure 6:
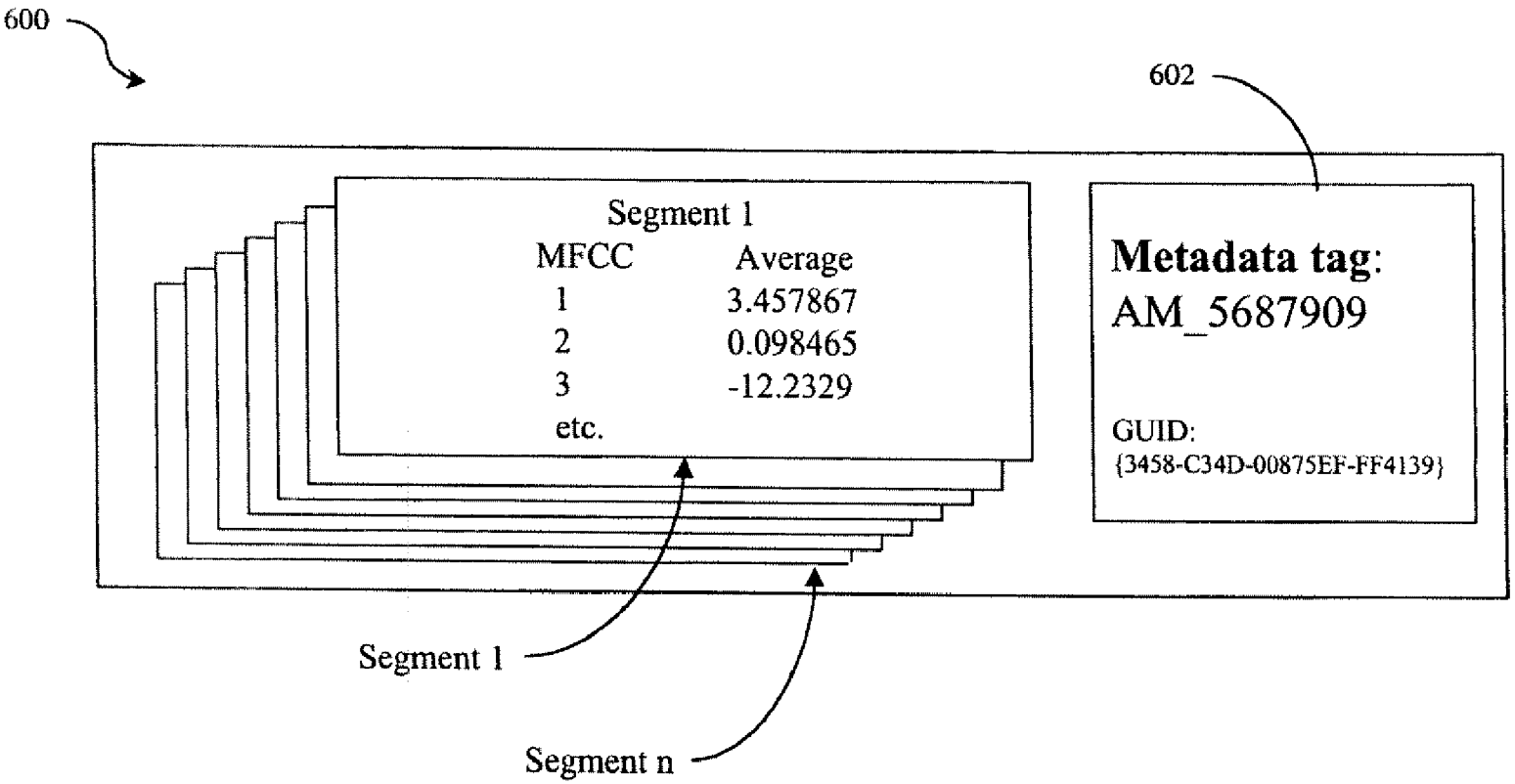
FIG. 6 is a diagram of a signature according to the present invention.

FIG. 6 is a diagram showing a complete signature 600 according to the present invention. Signature 600 includes a plurality of segment feature vectors 1 through n generated as shown and described above. Signature 600 may also include an identification portion containing a unique ID. It is contemplated that the identification portion may contain a unique identifier provided by the RIAA (Recording Industry Association of America). The identification portion may also contain information such as the UPC (Universal Product Code) of the various products that contain the audio corresponding to this signature. Additionally, it is contemplated that the signature 600 may also contain information pertaining to the characteristics of the file itself, such as the hop size, segment size, number of segments, etc., which may be useful for storing and indexing.

Signature 600 may then be stored in a database and used for comparisons.

The following computer code in the C programming language provides an example of a database structure in memory according to the present invention:

```
typedef struct
{
    float   hopSize;            /* hop size */
    float   segmentSize;        /* segment size */
    MFSignature* signatures;    /* array of signatures */
} MFDatabase;
```

The following provides an example of the structure of a segment according to the present invention:

```
typedef struct
{
    char* id;                   /* unique ID for this audio clip */
    long    numSegments;        /* number of segments */
    float*  features;           /* feature array */
    long    size;               /* size of per-segment feature vector */
    float   hopSize;
    float   segmentSize;
} MFSignature;
```

The discussion of FIG. 6 provides an example of means for storing segments and signatures according to the present invention.

Figure 7:
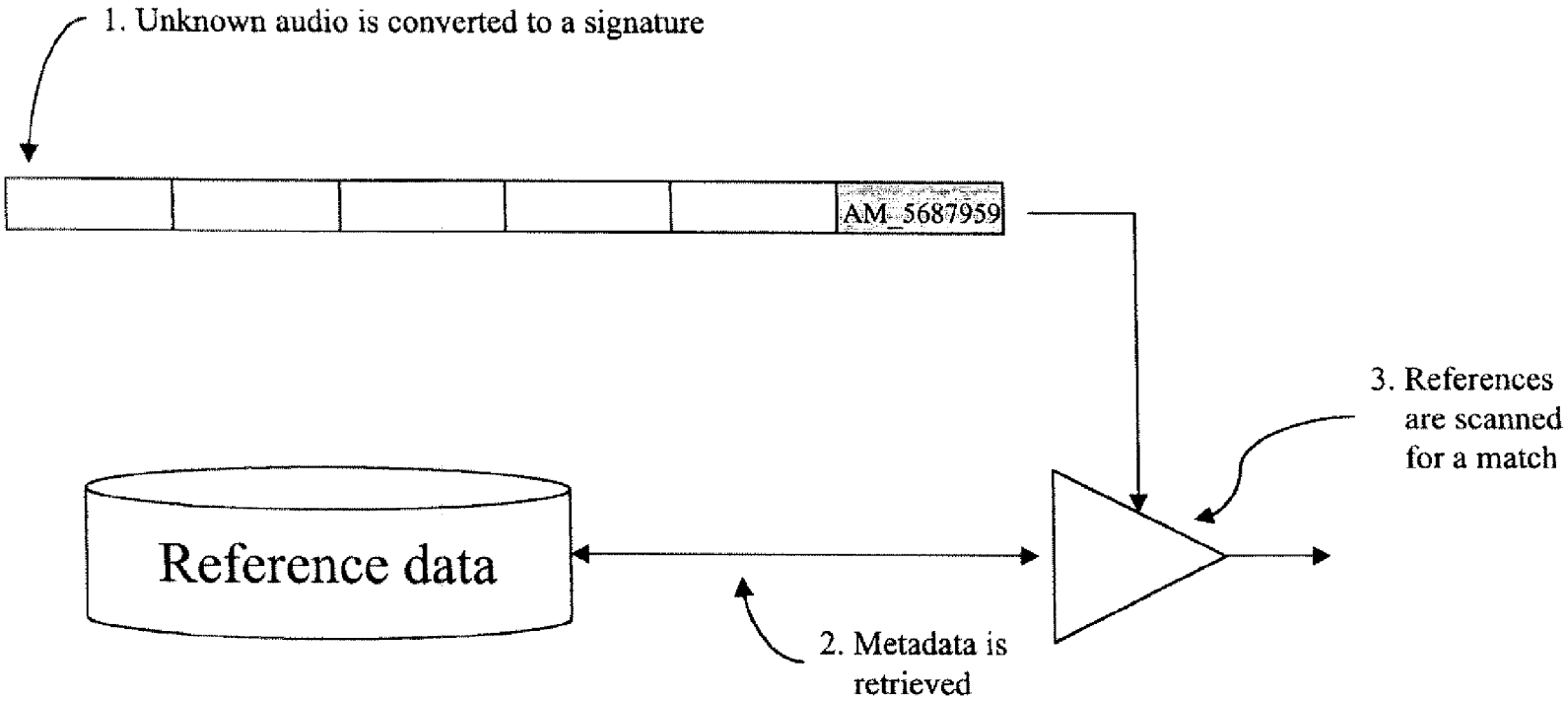
FIG. 7 is a functional diagram of a comparison process according to the present invention.

FIG. 7 shows a functional diagram of a comparison process according to the present invention. Act 1 of FIG. 7 shows unknown audio being converted to a signature according to the present invention. In act 2, reference signatures are retrieved from a reference database. Finally, the reference signatures are scanned and compared to the unknown audio signatures to determine whether a match exists. This comparison may be accomplished through means known in the art. For example, the Euclidean distance between the reference and real-time signature can be computed and compared to a threshold.

It is contemplated that the present invention has many beneficial uses, including many outside of the music piracy area. For example, the present invention may be used to verify royalty payments. The verification may take place at the source or the listener. Also, the present invention may be utilized for the auditing of advertisements, or collecting Arbitron®-like data (who is listening to what). The present invention may also be used to label the audio recordings on a user's hard disk or on the web.

While embodiments and applications of this invention have been shown and described, it would be apparent to those skilled in the art that many more modifications than mentioned above are possible without departing from the inventive concepts herein. The invention, therefore, is not to be restricted except in the spirit of the appended claims.

The invention claimed is:

1. A method for determining an identity of an unknown sampled work, said method comprising:

receiving, by a computer system, data of said unknown sampled work;

segmenting, by the computer system, said data of said unknown sampled work into a plurality of segments, said segments having a predetermined segment size and a predetermined hop size;

creating, by the computer system, a plurality of signatures wherein each of the plurality of signatures is a signature of one of said plurality of segments and wherein each of said plurality of signatures is of said predetermined segment size and said predetermined hop size;

comparing, by the computer system, said plurality of signatures of said unknown sampled work to a plurality of reference signatures of each of a plurality of reference works wherein said plurality of reference signatures of each of said plurality of reference works are created from a plurality of segments of said each of said plurality of reference works having a known segment size and a known hop size and said predetermined hop size of each of said plurality of segments of said unknown sampled work is less than said known hop size; and identifying, by the computer system, said unknown sample work responsive to said comparison of said plurality of signatures of said unknown sampled work to said signatures of said plurality of reference works.

2. The method of claim 1, wherein said creating a plurality of signatures of said unknown sampled work compromises calculating segment feature vectors for each segment of said sampled work.

3. The method of claim 1, wherein said creating a plurality of signatures of said unknown sampled work comprises calculating a plurality of MFCCs for each said segment.

4. The method of claim 1, wherein said creating a plurality of signatures of said unknown sampled work comprises calculating a plurality of acoustical features from the group consisting of at least one of loudness, pitch, brightness, bandwidth, spectrum and MFCC coefficients for each said segment.

5. The method of claim 1, wherein said unknown sampled work signature comprises a plurality of segments and an identification portion.

6. The method of claim 1, wherein said plurality of segments of said unknown sampled work signature comprise a segment size of approximately 0.5 to 3 seconds.

7. The method of claim 6, wherein said plurality of segments of said unknown sampled work signature comprise a hop size of less than 50% of the segment size.

8. The method of claim 6, wherein said plurality of segments of said unknown sampled work signature comprise a hop size of approximately 0.1 seconds.

9. A non-transitory computer readable storage medium, comprising executable instructions which when executed on a processing system cause the processing system to perform a method comprising:

receiving data of an unknown sampled work;

segmenting said data of said unknown sampled work into a plurality of segments, said segments having a predetermined segment size and a predetermined hop size;

creating a plurality of signatures wherein each of the plurality of signatures is a signature of one of said plurality of segments and wherein each of said plurality of signatures is of said predetermined segment size and said predetermined hop size;

comparing said plurality of signatures of said unknown sampled work to a plurality of reference signatures of each of a plurality of reference works wherein said plurality of reference signatures of each of said plurality of reference works are created from a plurality of segments of said each of said plurality of reference works having a known segment size and a known hop size and said predetermined hop size of each of said plurality of segments of said unknown sampled work is less than said known hop size; and identifying said unknown sampled work responsive to said comparison of said plurality of signatures of said unknown sampled work to said signatures of said plurality of references works.

10. The computer readable storage medium of claim 9, wherein said creating a plurality of signatures of said unknown sampled work compromises calculating segment feature vectors for each segment of said unknown sampled work.

11. The computer readable storage medium of claim 9, wherein said creating a plurality of signatures of said unknown sampled work comprises calculating a plurality of MFCCs for each said segment.

12. The computer readable storage medium of claim 9, wherein said creating a plurality of signatures of said unknown sampled work comprises calculating a plurality of acoustical features from the group consisting of at least one of loudness, pitch, brightness, bandwidth, spectrum and MFCC coefficients for each said segment.

13. The computer readable storage medium of claim 9, wherein said unknown sampled work signature comprises a plurality of segments and an identification portion.

14. The computer readable storage medium of claim 9, wherein said plurality of segments of said unknown sampled work signature comprises a segment size of approximately 0.5 to 3 seconds.

15. The computer readable storage medium of claim 14, wherein said plurality of segments of said unknown sampled work signature comprise a hop size of less than 50% of the segment size.

16. The computer readable storage medium of claim 14, wherein said plurality of segments of said unknown sampled work signature comprises a hop size of approximately 0.1 seconds.

* * * * *